US006247919B1

(12) United States Patent
Welz, Jr. et al.

(10) Patent No.: US 6,247,919 B1
(45) **Date of Patent: *Jun. 19, 2001**

(54) INTELLIGENT BURNER CONTROL SYSTEM

(75) Inventors: Albert W. Welz, Jr.; John D. Parker; Brenda J. Marchetti, all of Westford, MA (US)

(73) Assignee: Maxon Corporation, Muncie, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/456,229

(22) Filed: Dec. 7, 1999

Related U.S. Application Data

(63) Continuation-in-part of application No. 08/966,280, filed on Nov. 7, 1997, now Pat. No. 5,997,280.

(51) Int. Cl.[7] ..... F23D 14/60

(52) U.S. Cl. ..... 431/13; 431/17; 137/554

(58) Field of Search ..... 431/12, 13, 17, 431/89; 340/606; 137/486, 487.5, 100, 554, 101.19; 110/190

(56) References Cited

U.S. PATENT DOCUMENTS

| | | | | |
|---|---|---|---|---|
| 3,828,237 | | 8/1974 | Ko et al. . | |
| 4,043,742 | | 8/1977 | Egan et al. . | |
| 4,204,830 | | 5/1980 | Jones et al. . | |
| 4,348,169 | * | 9/1982 | Swithenbank et al. | 431/89 |
| 4,357,135 | | 11/1982 | Wilde et al. . | |
| 4,375,950 | * | 3/1983 | Durley, III | 431/12 |
| 4,484,947 | | 11/1984 | Marshall . | |
| 4,577,278 | | 3/1986 | Shannon . | |
| 4,645,450 | | 2/1987 | West . | |
| 4,712,996 | | 12/1987 | Adams et al. . | |
| 4,798,531 | | 1/1989 | Breckner . | |
| 4,885,573 | * | 12/1989 | Fry et al. | 431/13 |
| 4,927,351 | | 5/1990 | Hagar et al. . | |
| 5,085,576 | | 2/1992 | Bonne et al. . | |
| 5,236,328 | | 8/1993 | Tate et al. . | |
| 5,425,316 | * | 6/1995 | Malone | 110/190 |
| 5,433,174 | | 7/1995 | Brady et al. . | |
| 5,549,137 | * | 8/1996 | Lenz et al. | 137/486 |
| 5,658,140 | | 8/1997 | Kondou et al. . | |
| 5,685,707 | | 11/1997 | Ramsdell et al. . | |
| 5,779,466 | * | 7/1998 | Okamura | 431/89 |
| 5,997,280 | * | 12/1999 | Welz, Jr. et al. | 431/89 |

FOREIGN PATENT DOCUMENTS

| | | |
|---|---|---|
| 1317356 | 5/1993 | (CA) . |
| 2 138 610A | 10/1984 | (GB) . |
| 2 169 726A | 11/1984 | (GB) . |
| 2 138 610B | 10/1986 | (GB) . |
| 2 169 756B | 11/1988 | (GB) . |

* cited by examiner

*Primary Examiner*—Sara Clarke
(74) *Attorney, Agent, or Firm*—Barnes & Thornburg

(57) ABSTRACT

An intelligent burner control apparatus is configured to control the flow rate of a fluid flowing from a fluid supply to a burner. The apparatus includes a flow controller, a flow regulator, and a flow monitor. The flow controller includes a sensor configured to measure the flow rate of the fluid. The flow controller is configured to determine a flow control signal based on a measured fluid flow rate. The flow regulator is configured to receive the flow control signal and includes a valve movable to control the flow rate of the fluid in response to the flow control signal. The flow monitor is configured to monitor a change in the position of the valve with respect to the measured fluid flow rate and to produce an alarm signal when the change in the position of the valve with respect to the measured fluid flow rate is outside of a predetermined threshold.

18 Claims, 9 Drawing Sheets

INTELLIGENT BURNER CONTROL SYSTEM

This application is a continuation-in-part of application Ser. No. 08/966,280, filed Nov. 7, 1997, now U.S. Pat. No. 5,997,280.

BACKGROUND AND SUMMARY OF THE INVENTION

The present invention relates to control systems and particularly to systems for controlling fluid flow. More particularly, the present invention relates to electronic control systems for regulating flow of air and fuel for industrial burners.

Industrial burners typically operate under varying conditions such as variable fuel and air supply pressures and temperatures, back pressure from the burner, humidity, fuel quality, etc. In comparison to a burner control system that is calibrated for a particular set of operating conditions, a control system that automatically compensates for changes in the burner operating environment will optimize burner performance over the changing conditions. A burner control system that provides improved precision in regulating the flow of air and fuel will allow for operation over a wider burner turndown and increase overall burner efficiency, resulting in reduced emissions over the entire operating range, as well as increasing reliability and burner operating life.

In accordance with the present invention, an intelligent burner control apparatus is provided for controlling the rate of a fluid flow in a burner system from a fluid supply to a burner. The burner system includes an electronic communication network. The apparatus includes a flow controller including a sensor and a communication module. The sensor is configured to be coupled between the fluid supply and the burner to measure the fluid flow rate. The communication module is configured to be coupled to the communication network to send a flow control signal. The flow controller is configured to determine the flow control signal based on the measured fluid flow rate. The apparatus also includes a flow regulator including a communication module and an actuator. The communication module of the flow regulator is configured to be coupled to the communication network to receive the flow control signal. The actuator is configured to be coupled between the fluid supply and the burner to control the fluid flow rate. The flow regulator is configured to command the actuator based on the flow control signal. burner to control the fluid flow rate. The flow regulator is configured to command the actuator based on the flow control signal.

In preferred embodiments, the sensor is a mass flow sensor, such as a thermal mass flow sensor. The actuator can include a variable speed blower, or a valve actuator coupled to a valve assembly, or both a variable speed blower and a valve actuator coupled to a valve assembly. The communication network can be a peer-to-peer communication network.

The intelligent burner control apparatus further includes a brain module configured to be coupled to the communication network and to send a flow set point signal indicative of a desired fluid flow rate over the communication network. The flow controller module is configured to receive the flow set point signal and determine the flow control signal based on the measured flow rate and flow set point signal. The brain module can be configured to receive a firing rate signal and to determine the flow set point based on the firing rate signal. The brain module can monitor the rate of change in the firing rate signal from a process controller, and if the rate of change exceeds a predetermined threshold then the burner brain determines and sends a plurality of intermediate setpoints over the communication network.

The intelligent burner control apparatus further includes a display module configured to be coupled to the communication network. The display module includes a display terminal and is configured to receive at least one display signal over the communication network. The display module provides an indication on the display terminal indicative of the display signal. The intelligent burner control apparatus can include a command module configured to be coupled to the communication network. The command module includes a user input device for sending at least one user command over the communication network.

Additional features of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION

Figure 1:
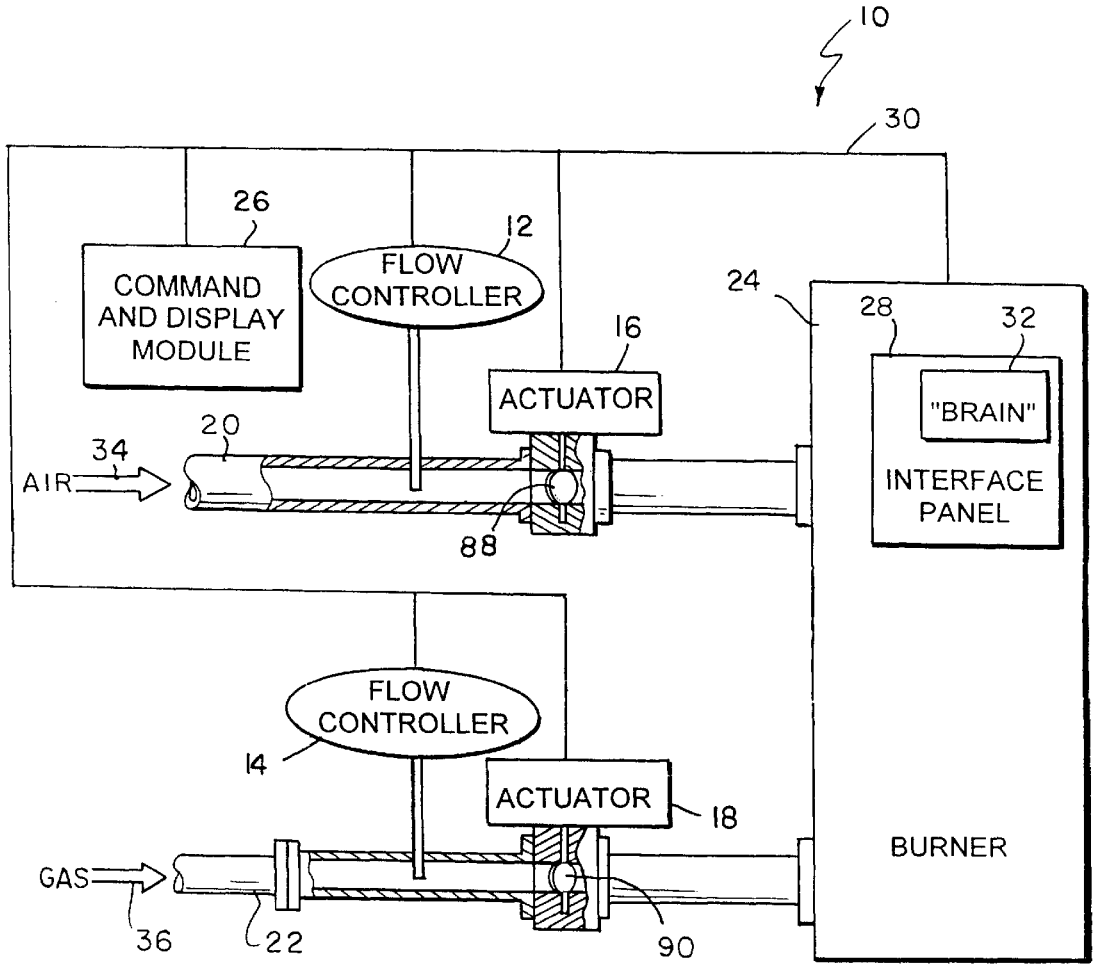
FIG. 1 is a component block diagram showing modular flow measurement and actuator modules according to the present invention installed into air and gas pipe train components of a burner system, the flow and actuator modules communicating over a peer-to-peer communication network with a burner "brain" module within an interface panel module and a command and display module.
Figure 5:
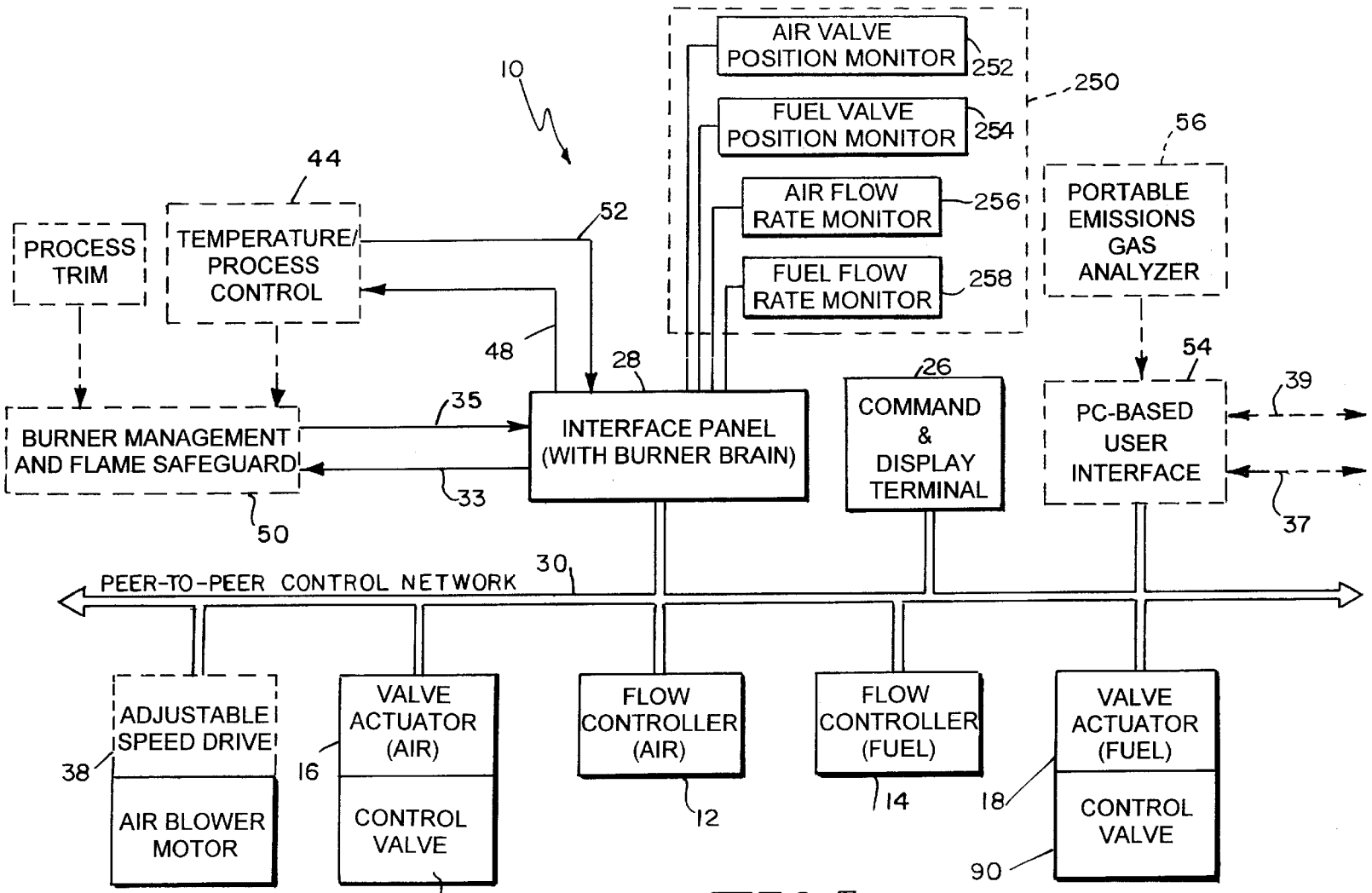
FIG. 5 is a network block diagram showing the modular components of the burner control system connected over the communication network, a PC user interface module for providing a gateway between the communication network and external systems such as a portable emissions gas analyzer or remote monitoring devices, and burner control signals to the interface panel module that includes the burner brain.

An intelligent burner control system 10 in accordance with the present invention having flow controller modules 12, 14 and valve actuator modules 16, 18 coupled to an air pipe 20 and gas pipe 22 of a pipe train assembly of a burner 24 is shown in FIG. 1. The flow controller modules 12, 14 and valve actuator modules 16, 18 communicate with a command and display module 26 and interface panel module 28 over a peer-to-peer communication network 30 as best shown in FIG. 5. Valve actuator modules 16, 18 are coupled to valves 88, 90 respectively to regulate the flow of air and fuel in pipes 20, 22. The interface panel module 28 includes a "brain" module 32 that cooperates with the flow controller modules 12, 14 and valve actuator modules 16, 18 to provide precise regulation of the flow of air 34 and gas 36 to burner 24.

In order to improve burner efficiency and reduce burner emissions, intelligent burner control system 10 provides intelligent, modular components to compensate automatically for changes in environmental parameters over the complete operating range of the burner. For example, by providing flow controller modules 12, 14 that perform closed loop control based on fluid flow mass rate, burner control system 10 automatically compensates for changes in fluid pressures and temperatures without needing to monitor these parameters. By providing high-precision modular components, burner control system 10 provides for operation over changing conditions, resulting in a wide burner turndown ratio that allows for reduced emissions and increased efficiency and reliability.

Modular burner control system 10 can be used to replace part or all of the air-fuel ratio control system in a burner control system, allowing for both a turnkey approach to installation as well as incorporation into existing designs. The use of intelligent components coupled to communication network 30 further provides the ability to monitor or to manage the control system remotely. The modular architecture simplifies installation, modification, and operation of burner control system 10.

Figure 2:
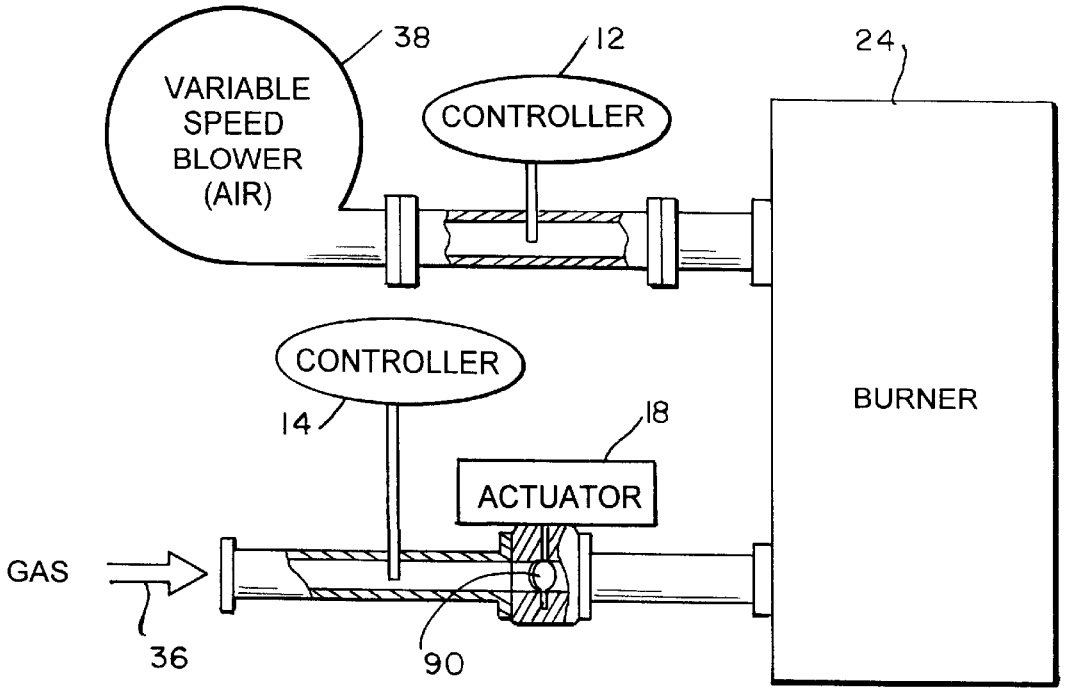
FIG. 2 is a block diagram similar to FIG. 1 showing the actuator module in the air pipe replaced by a variable speed air blower.

The intelligent modules 12, 14, 16, 18, 26, 32 provide a turnkey approach for air-fuel ratio control for burners that integrates easily into a conventional combustion control system. The modular architecture based on a peer-to-peer communication network 30 enables the control functions to be distributed throughout the networked components to provide maximum flexibility, reduced network complexity, increased precision, and increased system reliability. For example, the modular architecture allows for replacement of valve actuator module 16 and valve 88 in air pipe 20 with a variable speed blower 38 as shown in FIG. 2, without requiring modifications to the remaining modular components 12, 14, 18, 26, 32 within burner control system 10. Similarly, as discussed in more detail below, variable speed blower 38 can be combined with valve actuator module 16 and valve 88 to achieve more precise control of air flow over a wider range of operating conditions than is possible by using either variable speed blower 38 or valve actuator module 16 and valve 88 alone.

Figure 3:
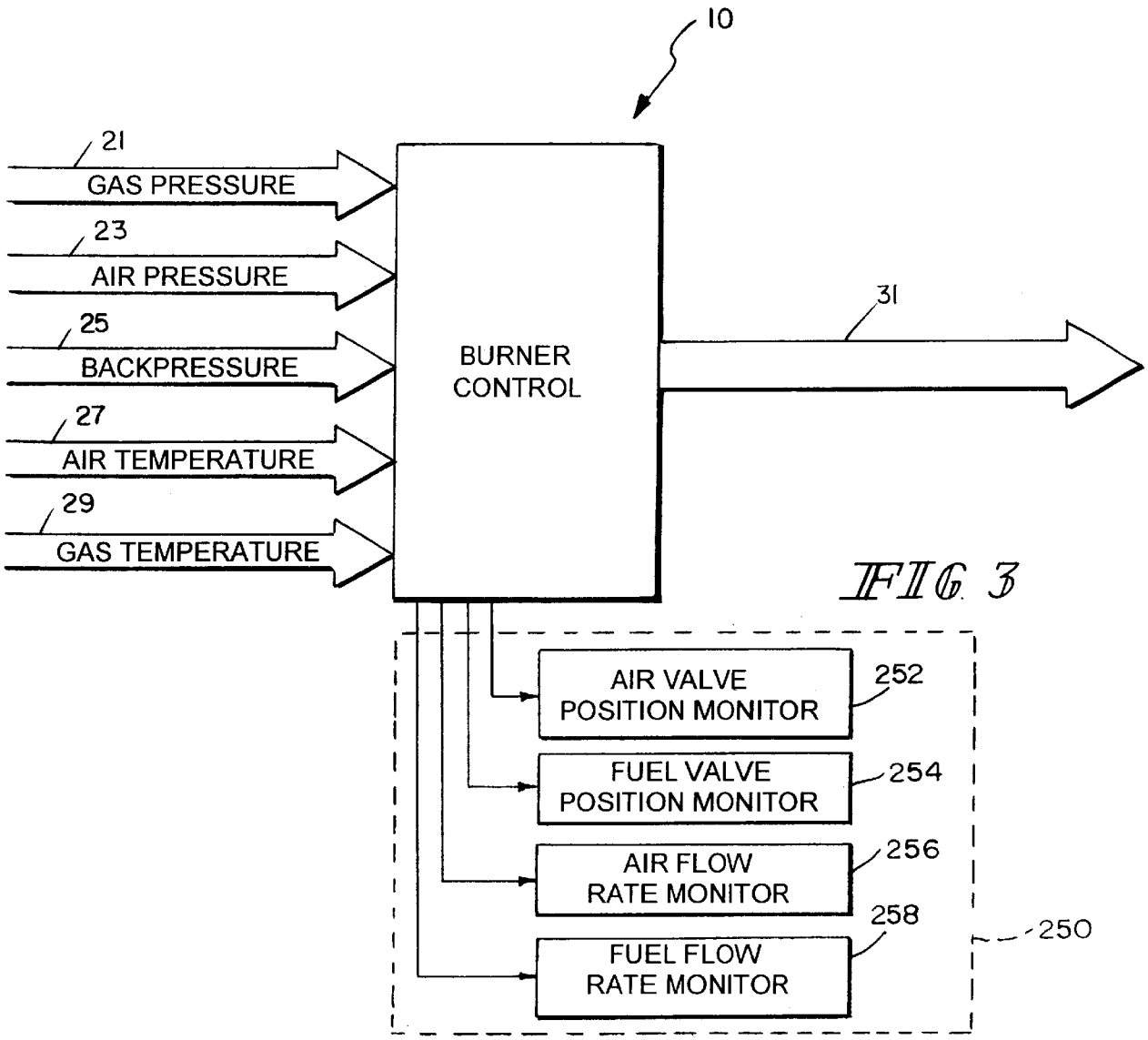
FIG. 3 is a conceptual diagram showing pressure and temperature environmental input parameters to and flow rate and valve position output monitors from a burner control system that regulates an air-fuel ratio output to the burner.

By using intelligent, micro-processor based modules to perform closed-loop control using mass flow rates of the air and fuel supplies to the burner, the burner control system 10 of the present invention can be configured to achieve desired burner performance while automatically compensating for a variety of operating conditions. For example, flow controllers 12, 14 are configured to measure mass flow directly and provide control signals to valve actuators 16, 18 so that burner control system 10 reacts automatically to variations in gas pressures 21, air pressures 23, back pressure 25, and air and gas temperatures 27, 29 in pipes 20, 22 to determine an air-fuel ratio 31. See FIG. 3. The modular, microprocessor based architecture further contemplates integrating additional sensor data into the control system, such as providing humidity and fuel sensor data directly to burner brain 32 which then the valve actuator modules 16, 18 for use in adjusting the air-fuel ratio 31 to burner 24 based on these inputs.

Burner control system 10 also provides the ability to predict the emissions from burner 24, for example based on input parameters such as air and fuel mass flow. The emission characteristics for burner 24, such as $NO_x$ and CO emissions, can be experimentally determined as a function of air and fuel mass flow. Characteristic curves of burner emission performance based on air and fuel mass flow can then be generated. The expected $NO_x$ and CO emissions output from an operational burner 24 thus characterized can then be determined by software within any module coupled to the network, such as burner brain module 32, by using the actual air and fuel mass flow rates measured by flow controller modules 12, 14 in conjunction with the predetermined characteristic emissions curves. This predictive emissions capability can be used to complement, verify, or replace actual emissions monitoring to assist in compliance with various federal, state, and local environmental regulations.

Figure 4:
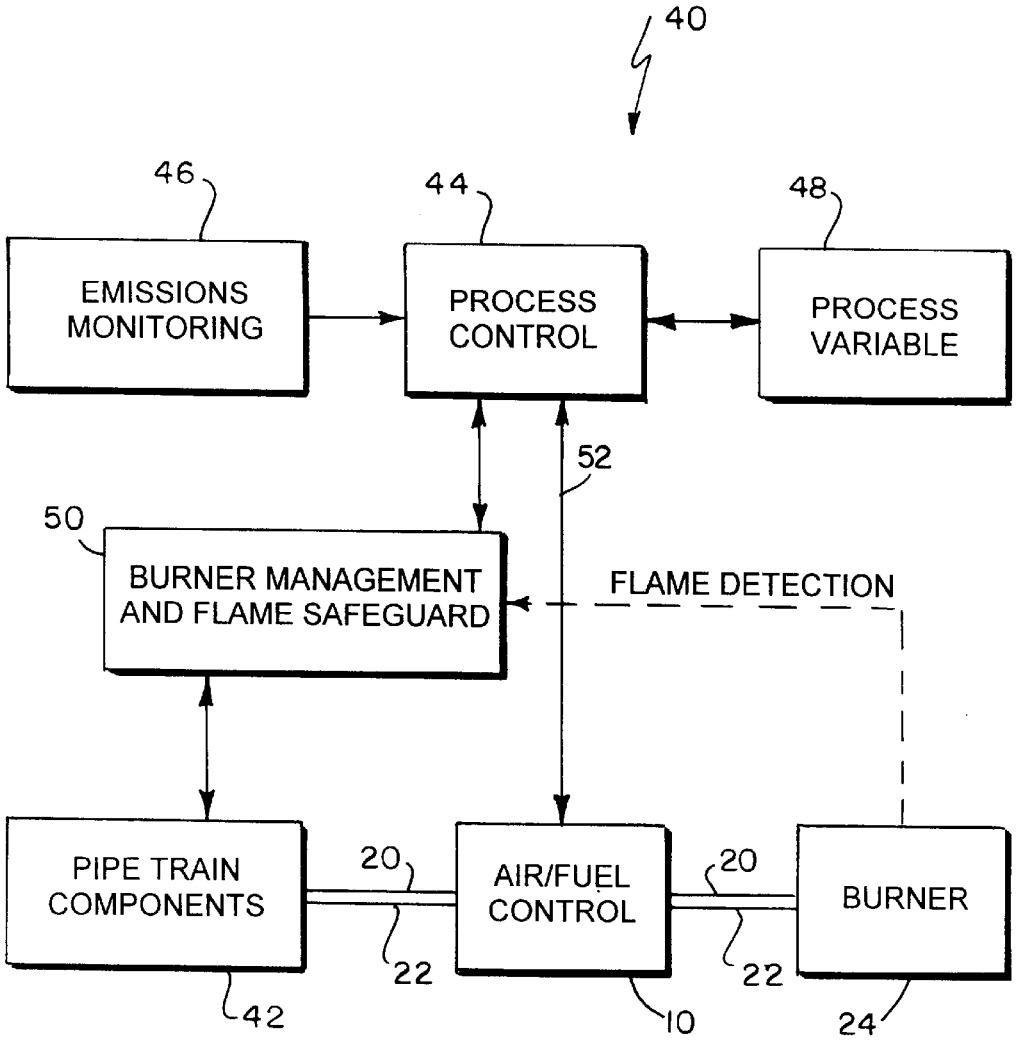
FIG. 4 is a system block diagram showing an industrial process control system that includes an air-fuel control system according to the present invention interposed between the pipe train components and a burner, and illustrating interfaces between a process controller and the air-fuel control system, an emissions monitoring component, a burner management and flame safeguard component, and process variables.

Elements of a typical industrial heating system 40 incorporating burner control system 10 for air and fuel control are shown in the block diagram of FIG. 4. Heating system 40 illustratively includes the burner control system 10 coupled to burner 24, pipe train 42, and a process controller 44. Process controller 44 can be a distributed control system computer, a programmable logic controller, an application specific universal digital controller, or the like, and manages one or more process variables 48, such as oven temperature. Process controller 44 is also coupled to an emissions monitoring system 46 which can monitor emissions continuously or on a sampled basis.

Process controller 44 provides a firing rate signal 52 to burner control system 10, where firing rate signal 52 represents a percentage of firing rate for burner 24. Firing rate is illustratively an analog signal where firing rate is proportional to signal current, but any analog or digital signal could be used to command firing rate. The command signal from process controller 44 to burner control system 10 can be any parameter indicative of desired burner 24 performance. Burner control system 10 controls the air and fuel flow rates to burner 24 to achieve the firing rate commanded by process controller 44. Process controller 44 is illustratively coupled to burner brain 32 through an analog firing rate signal 52, but that other interfaces such as a serial Input/Output interface or communication over network 30 is contemplated.

A burner management and flame safeguard element 50 is coupled to process controller 44 and contains monitoring and control logic to light burner 24 and to shutdown burner 24 if it detects an absence of a flame or if commanded by process controller 44. Burner management and flame safeguard element 50 is further coupled to pipe train 42, which contains various permissive interlocks required for safe starting and operation of burner 24. Burner management and flame safeguard element 50 also monitors parameters such as high and low gas pressure, low air pressure, high process temperatures, and the like.

Process controller 44 provides the firing rate signal 52 to interface panel module 28 of burner control system 10 as shown in FIG. 5. Interface panel module 28 provides burner status information to process controller 44. Burner brain module 32 within interface panel module 28 then translates firing rate signal 52 into an air flow setpoint and a fuel flow setpoint using software based on known performance characteristics of burner 24. Burner brain module 32 transmits the air and fuel flow setpoints to air flow and gas flow controller modules 12, 14 respectively over the peer-to-peer communication network 30. Air and gas flow controller modules 12, 14 in turn measure the air and gas mass flow rates and determine valve position commands that are sent over network 30 to air and gas valve actuator modules 16, 18. Air and gas flow controller modules thus automatically compensate for variations in pressure and temperature by performing closed-loop control of valve position based directly on mass flow rate. Similarly, air and gas valve actuator modules 16, 18 automatically compensate for changing environmental parameters, including mechanical factors such as hysterisis in valves 88, 90, by performing closed-loop control based on measured valve position to drive valves 88, 90 to the commanded positions.

Flow monitoring system 250 provides continuous monitoring of air flow 34 and fuel flow 36 and alarms on out-of-range conditions for a particular process outside of the operating range of burner 24. Flow monitoring system 250 is a separate embedded processor in burner brain module 32 and can be enabled or disabled through command and display module 26. Flow monitoring system includes an air valve position monitor 252, a fuel valve position monitor 254, an air flow rate monitor 256, and a fuel flow rate monitor 258. During the operation of burner 24, air valve position monitor 252 continuously monitors and records the changes in the position of air valve 88, in degrees, with respect to the rate of air flow 34 monitored by air flow rate monitor 256. Similarly, during the operation of burner 24, fuel valve position monitor 254 continuously monitors and records the changes in the position of fuel valve 90, in degrees, with respect to the rate of fuel flow 36 monitored by fuel flow rate monitor 258. The operator of intelligent burner control system 10 can observe, through the command and display module 26, the results of monitoring by flow monitoring system 250 in degrees of valve position change over the flow range. The operator can reset the flow monitoring results when desired. The flow monitoring results are also reset when intelligent burner control system 10 power is cycled off and on.

Flow monitoring system 250 permits the operator to specify the normal operating parameters regarding the position of air and fuel valves 88, 90 with respect to air and fuel flow rates 34, 36 and alerts the operator when these parameters are outside of a desired range. An alarm is displayed through command and display module 26 when the change in position of either air valve 88 or fuel valve 90 for a given rate of air flow 34 or rate of fuel flow 36 is outside of a selected threshold. The operator can adjust this threshold for either air valve 88 or fuel valve 90 threshold through command and display module 26, for example, to accommodate expected changes in a particular process environment. This alarm indicates, for example, that there are possible changes in fuel or air supply pressures 21, 23, blocked combustion air filter, flow controller module 12, 14 failures, or large changes in chamber back pressure.

Flow monitoring system 250 also provides early detection of needed maintenance (e.g., filters need to be cleaned), which could reduce or prevent unnecessary down time in the factory. The monitors 252, 254, 256, 258 can be linked to hardware/software to track trends in the readings taken by monitors 252, 254, 256, 258. Based on these trends, necessary maintenance can be detected.

When variable speed blower 38 replaces air valve actuator module 16 for controlling air flow 34 to burner 24, air flow controller module 12 will provide a blower frequency setpoint to produce the appropriate flow. Variable speed blower 38 can be used in conjunction with air valve actuator module 16, in which case air flow controller module 12 will command a blower frequency setpoint slightly higher than necessary to produce the desired flow rate and will command air valve actuator module 16 to trim the air flow to achieve the desired flow rate. This primary-secondary control approach allows air flow controller module 12 to maintain valve actuator module 16 in a configuration that maximizes precision. For example, the air flow rate can be varied so that a butterfly valve can operate as a secondary trim around its peak precision orientation of forty-five degrees. The air flow can be varied by primary air flow regulator, for example, variable speed blower 38, to maximize the precision characteristics of any type of secondary flow regulator used as secondary trim. Any suitable mechanism can be used for the primary control of air flow rate, such as another type of valve mechanism instead of variable speed blower 38.

Figure 6:
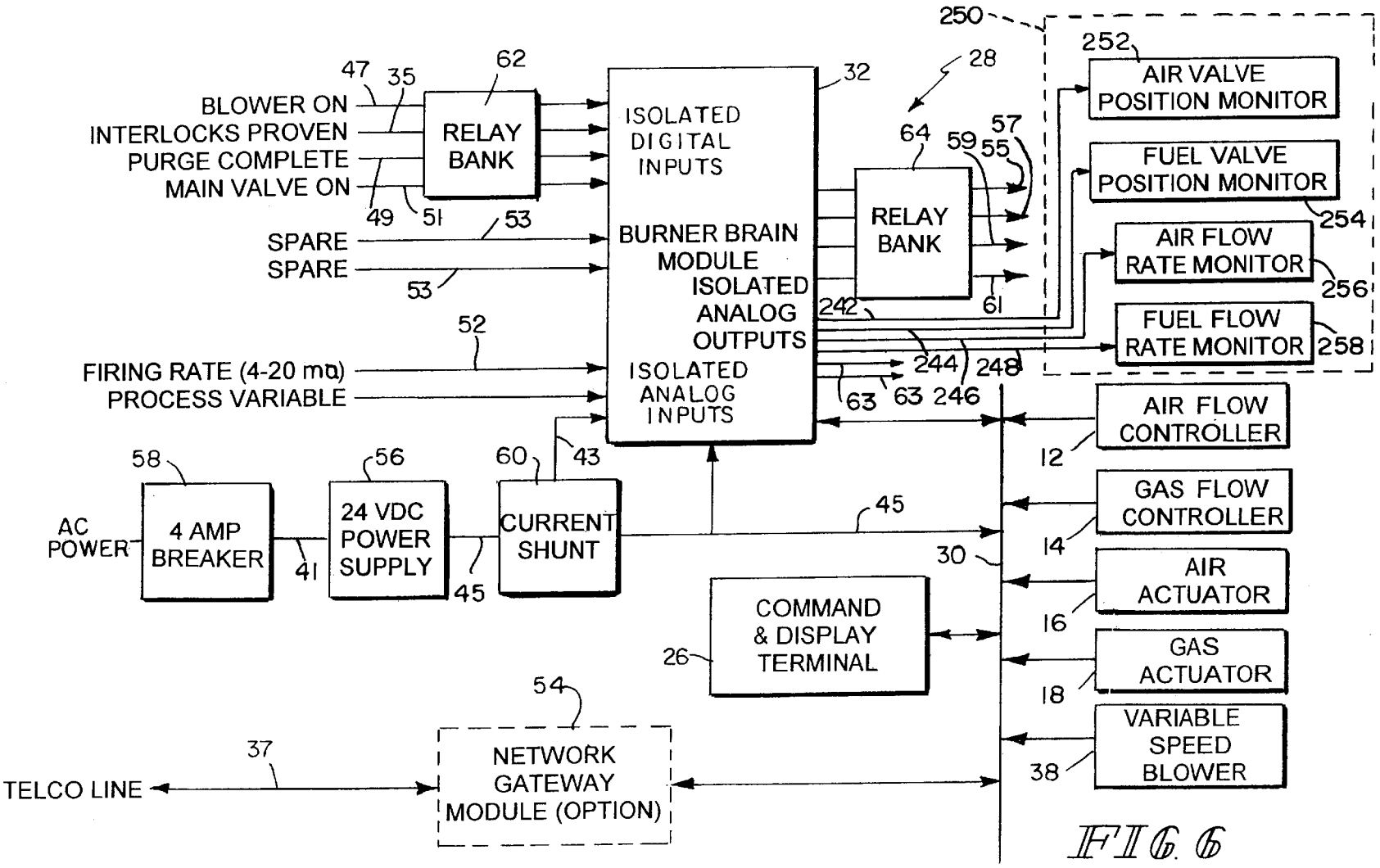
FIG. 6 is a schematic block diagram of the interface panel module including the burner brain module, showing relay switched discrete Input/Output, isolated analog inputs, isolated analog outputs, and burner control system parameters conveyed over the communication network.

The interface control panel module 28 including burner brain module 32 is shown in detail in FIG. 6. A 24 volt direct current power supply 56 is coupled to the alternating current power supply input 41 through four amp circuit breaker 58 to provide power 45 to the module components and also for peer-to-peer communication network 30. Power supply 56 can be any suitable commercial power supply, and illustratively a five amp power supply is used for a burner control system requiring two amps, with the extra power capacity providing for improved reliability and higher temperature operations. A current shunt 60 provides a power supply monitor input 43 to burner brain module 32 for diagnostic purposes.

Discrete I/O to and from interface panel module 28 is electrically isolated by use of relay banks 62, 64. Discrete input signals to burner brain module 32 are isolated by relay bank 62 and include blower on 47, interlocks proven 35, purge complete 49, and main valve on signals 51. Burner brain module 32 is also capable of receiving other spare input signals 53 to provide for added capacity. Discrete outputs are isolated by a relay bank 64 and include burner enable 55, call for heat 57, and alarm signals 59. Burner brain module 32 similarly includes spare discrete and analog output signals 61, 63 to provide for additional capacity. The firing rate analog signal 52 from process controller 44 is coupled through interface control panel 28 to burner brain module 32.

Burner brain module 32 also includes isolated analog output signals 242, 244, 246, and 248 to air valve position monitor 252, fuel valve position monitor 254, air flow rate monitor 256, and fuel flow rate monitor 258, respectively.

Communication network 30 is illustratively a LonWorks™ peer-to-peer communication network from Echelon, although any suitable communications network can be used. Communication network 30 and network system power bus share a four conductor communication cable, one shielded twisted pair being used for power and another shielded twisted pair being used for communication, with both networks being appropriately terminated by termination filter 71 in interface panel module 28.

Command and display module 26 is coupled to the peer-to-peer communication network 30 within panel module 28 to provide local monitoring and control functions. Command and display module 26 can display any of the parameters sent over network 30 by the intelligent modules 12, 14, 16, 18, 32, including values of external signals to the modules and internal parameters used by the modules. Module 26 can similarly command the various intelligent modules 12, 14, 16, 18, 32 to perform certain functions such as self-diagnostics, self-calibration, shut-down, etc. Command and display module 26 can be coupled to communication network 30 at any location, and that more than one such module can be used.

An optional network gateway module 54 can also be coupled to the peer-to-peer communication network within the interface panel 28 to provide an interface between the peer-to-peer communication network and an external network, for example through a standard telephone line 37, Ethernet transceiver 39, or the like. Although network gateway module 54 is located in interface panel 28, it can also be located anywhere on communication network 30. Network gateway module 54 can be used, for example, to provide a remote command and display interface to burner control system 10.

Figure 7:
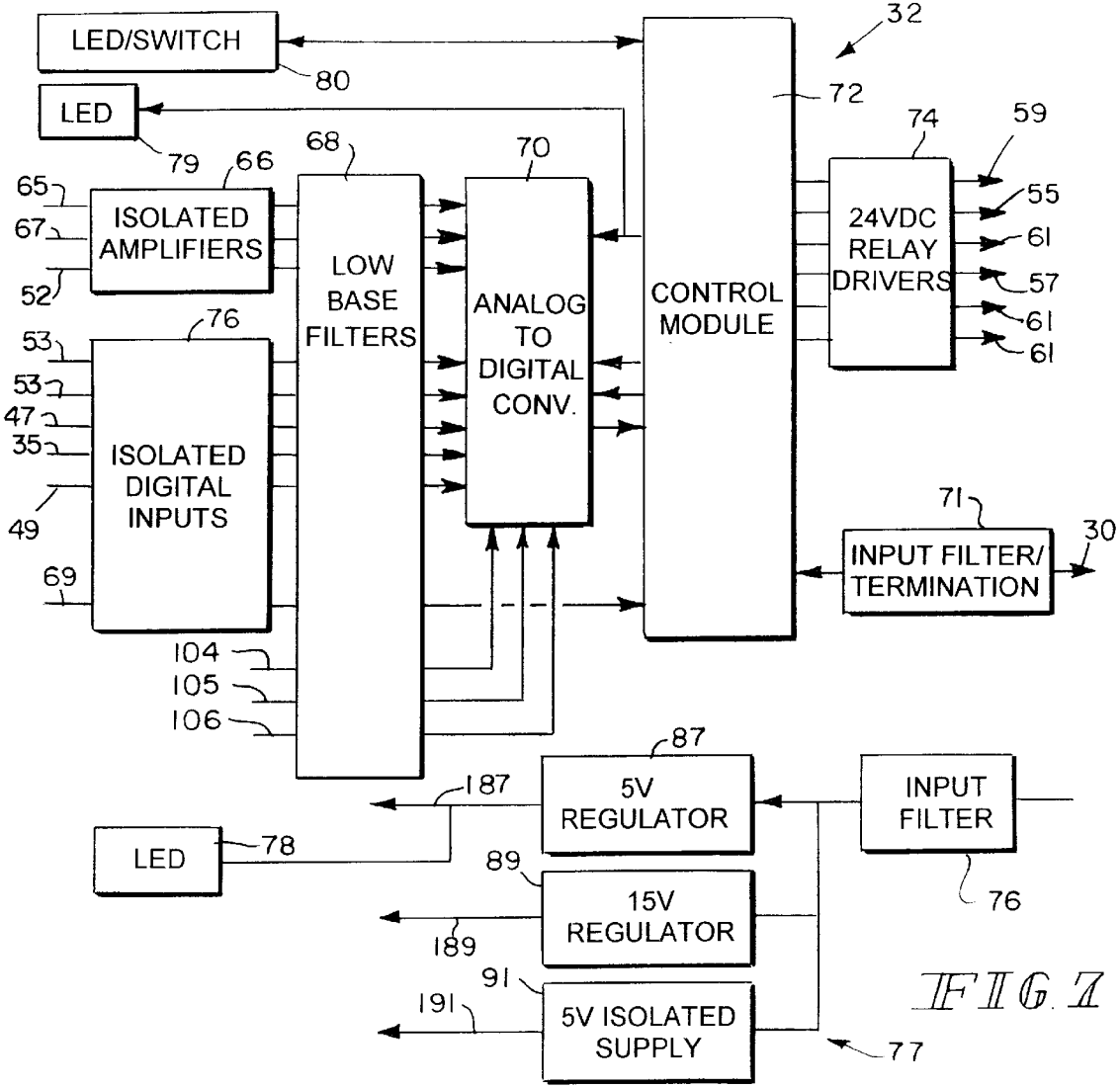
FIG. 7 is a schematic block diagram of the burner brain module showing isolated external Input/Output, direct internal Input/Output, regulated power, and a connection to the peer-to-peer communication network.

Details of burner brain module 32 are shown in FIG. 7. Burner brain 32 includes software for controlling air and fuel flows as a function of firing rate for the specific type of burner 24 and supplies the appropriate flow setpoints to the air and fuel flow controller modules 12, 14 over network 30.

The software in burner brain 32 includes algorithms to ensure proper transformation of firing rate input commands to air and fuel setpoint output commands. When a firing rate command input changes, burner brain 32 will determine intermediate firing rate step changes in the fuel setpoint command outputs to ensure that the proper air-fuel ratio is maintained as the controller modules 12, 14 command the actuator modules 16, 18 to achieve the new burner output. By having knowledge of the air and fuel flow regulation performance, that is, the flow controller and valve actuator modules, this approach allows burner brain 32 to achieve the most efficient rate of change in burner 24 output while maintaining a safe condition, that is, maintaining a proper air-fuel ratio during transition between commands. By including predefined knowledge of performance characteristics of various flow controller, valve actuator, and variable speed blower modules in burner brain 32, the burner control system 10 can automatically accommodate a variety of module configurations. Burner brain 32 can be updated to accommodate changes in performance characteristics of other modules in the flow regulation system, for example by communicating performance characteristic information to burner brain 32 over communication network 30 or by providing modified software.

Burner brain 32 also monitors the discrete inputs and controls the discrete outputs to interface panel 28 discussed above. The blower on discrete input is used to signal burner brain 32 to command the optional variable speed blower to start. The interlocks proven discrete input indicates that all permissive interlocks, such as low air pressure, low and high gas pressure, and excess temperature are within range for operating burner 24. The purge complete discrete input indicates that an external burner purge cycle has been completed and signals burner brain 32 to command an appropriate air flow setting to start burner 24. The main valve on discrete input indicates that burner 24 is lit and under temperature control. Burner brain 32 can also be configured to receive any or all of these inputs over communication network 30.

The discrete outputs from burner brain 32 are coupled through 24 VDC relay drivers 74. Discrete outputs include a burner enable discrete output 33 used as an interlock by burner management and flame safeguard element 50 and a call for heat discrete output to enable actuation of a main valve of burner 24 that is turned on by burner management and flame safeguard component 50. There is also an alarm discrete output 59 that can be used for purposes such as turning on an indicator light (not shown) or can be coupled to process controller 44. Although burner brain 32 illustratively drives discrete outputs 33, 57, 59 directly, the invention contemplates sending these commands over network 30. The status of all discrete outputs can also be communicated over communication network 30, as can the status of variables set or used within burner brain module 32.

External analog inputs to burner brain module 32 are electrically isolated by use of isolation amplifiers 66. Analog inputs include firing rate 52, power supply current shunt voltage 65, and an optional process variable 67, which can be humidity, fuel quality, or any parameter that may affect performance of burner control system 10. Although in an illustrative embodiment burner brain module 32 receives the analog firing rate signal 52 from process controller 44, burner brain 32 could receive a firing rate signal over communication network 30. Analog inputs are coupled from amplifiers 66 through a low pass filter 68 and analog-to-digital converter 70 to brain control module 72. Discrete input blower on 47, interlocks proven 35, purge complete 49, main valve on 69, and spare inputs 53 are also coupled to brain module 32 through low-pass filter 68 via drivers 76. Burner brain 32 can be configured to receive one or more process variables over network 30.

Control module 72 is an Echelon Neuron-based LonWorks™ control module, although it is understood that a module configured with any micro-processor, microcontroller or the like can be used. The Echelon NEURON™ processor includes a communications processor (not shown) that performs all network-related functions for communicating over network 30 and is coupled to the Echelon LonWorks™ communication network. A power supply circuit 77 for burner brain module 32 including a five volt regulator 87, a fifteen volt regulator 89, and a five volt isolated supply 91 is coupled to a filter 76 and provides filtered including five volt direct current logic power 187, fifteen volt direct current power 189, and five volt direct current isolated power 191 for on-board use. A twenty-four volt monitor signal 104, a fifteen volt monitor signal 105, and an ambient temperature signal 106 coupled to low pass filter 68 are also provided as inputs to control module 72. Burner brain module 32 further includes various status LED's 78, 79, 80 to indicate power status, service required, and control module board status.

Figure 8:
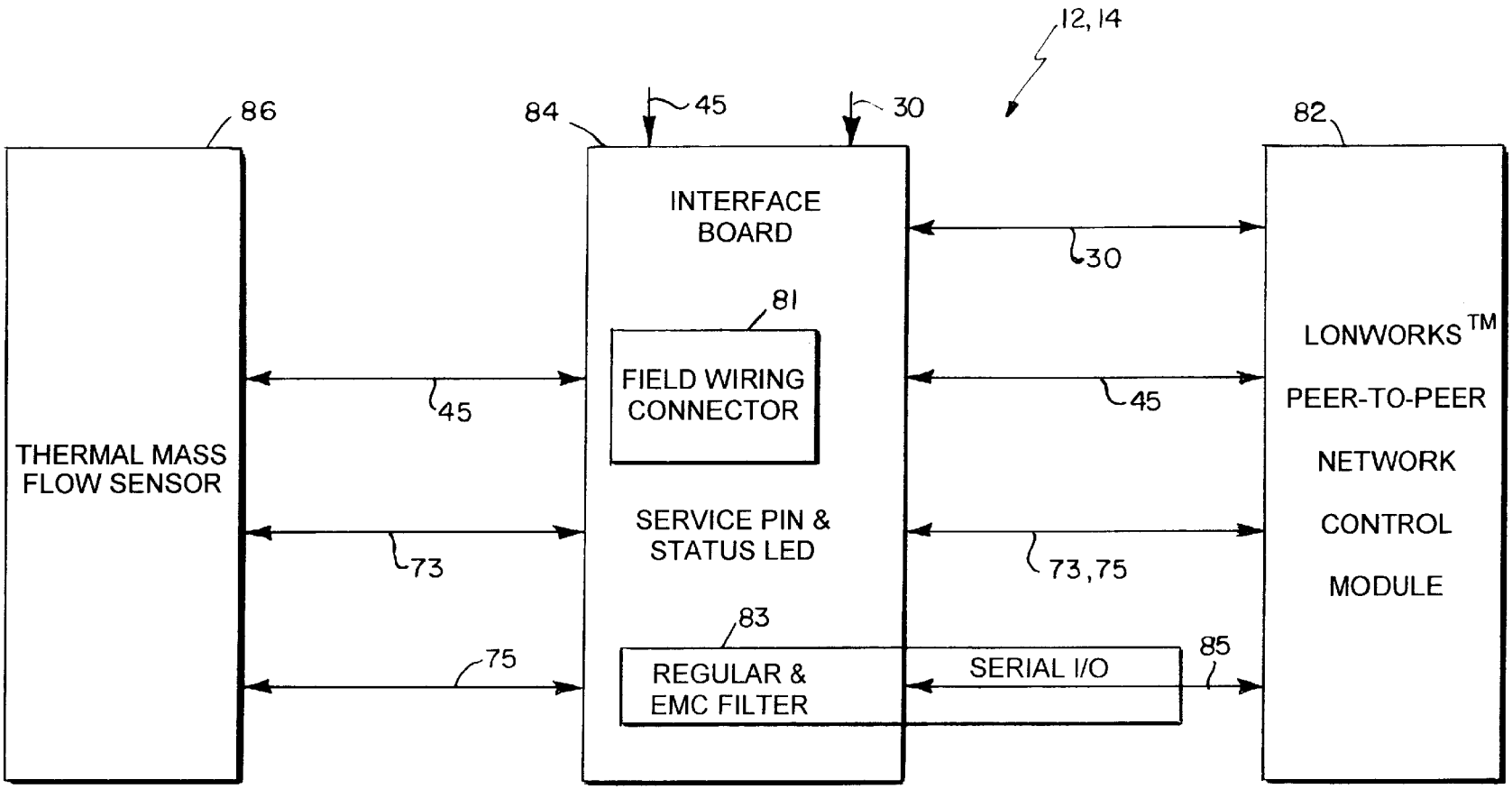
FIG. 8 is a block diagram of an intelligent flow controller including a thermal mass flow sensor configured with analog and serial interfaces, an interface board coupled to the mass flow sensor, and an Echelon LonWorks™ network control module coupled to the interface board for communication over the peer-to-peer network.

Flow controller modules 12, 14 each include an Echelon LonWorks™ control module 82 coupled to an interface board 84 as shown in FIG. 8. Similar to burner control module 32, flow controller modules 12, 14 also include a communications processor (not shown, but within LonWorks™ control module 82) coupled to communication network 30 that performs all network-related functions for communicating over network 30.

Interface board 84 in flow controller modules 12, 14 is in turn coupled to a flow sensor 86 that illustratively is a thermal mass flow sensor. Any sensor from which mass flow rate can be derived is suitable, although the presently preferred embodiment uses a thermal mass flow sensor that provides an output signal directly indicative of flow rate. Thermal mass flow sensor 86 is calibrated to provide a linear analog output of the flow rate through a pipe flow body (not shown) containing flow conditioning and having a known diameter. The system can also work with a calibrated non-linear signal from the flow sensor. Network control module 82 can interface with flow sensor 86 by any suitable communications protocol, such as a serial Input/Output interface.

Flow controller modules 12, 14 are configured to conform to the NEMA4X rating to ensure reliable operation in the burner control system environment. In order to ensure precise flow measurement and control, flow sensors 86 are keyed in order to ensure proper alignment within the pipe flow body.

Interface board 84 includes conditioning circuitry (not shown) to filter and digitize the analog Input/Output 73 to and from flow sensor 86 as well as handling serial Input/Output 75 for use by control module 82. Interface board 84 further includes power circuitry, status LEDs, filters 83, field connection wiring 81, network interface circuitry for coupling modules 12, 14 to communication network 30 and a serial Input/Output connection 85 to control module 82.

Valve actuator modules 16, 18 are coupled to butterfly valves 88, 90 respectively to regulate the gas and air flows 34, 36 as shown in FIG. 1. The position of valves 88, 90 corresponds to the position of valve actuator modules 16, 18, respectively. Any valve system could be used to regulate fluid flow in pipes 20, 22, and as discussed above the flow optionally can be regulated by means of a variable speed blower 38. Variable speed blower 38 can be any device that adjustably increases the fluid flow rate, such as a turbine, pump, or the like.

Figure 9:
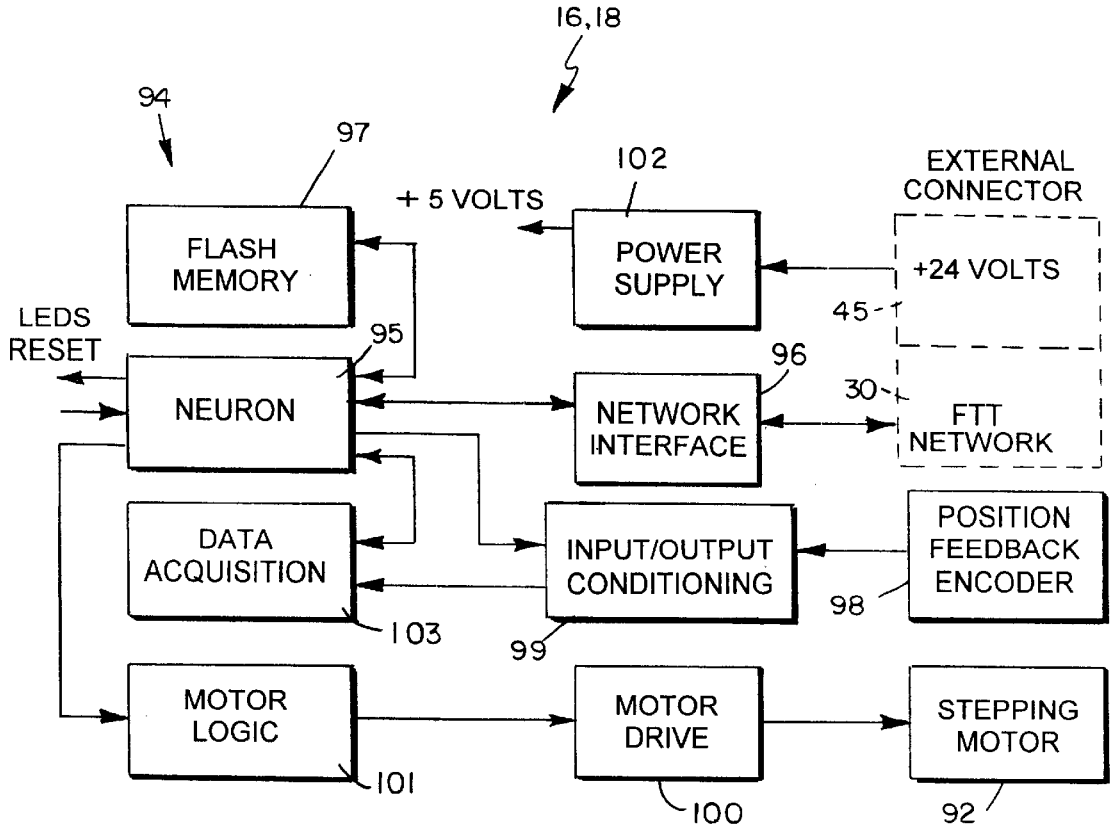
FIG. 9 is a block diagram of an intelligent valve actuator for regulating fluid flow including an Echelon NEURON™ processor having application code and data stored in a flash memory and a network interface for communicating over the network, the flow regulation module configured for autonomous closed loop control of a valve via a stepping motor command output and an encoded valve position feedback input.

Valve actuator modules 16, 18 are each coupled to valves 88, 90 through a stepping motor 92 as shown in FIG. 9. Stepping motor in turn is coupled to a planetary gear system (not shown) to provide precise rotational control of the position of valves 88, 90. The stepping motor is illustratively capable of driving 100 in-lb of torque and the planetary gear system has a 40:1 reduction ratio. It is understood that the invention contemplates any coupling mechanism for driving valves 88, 90 with actuators 16, 18, however, such as alternative gear systems, e.g., spur gears, or with any suitable electro-mechanical actuation design.

Like the burner brain 32 and flow controller 12, 14 modules, valve actuator modules 16, 18 use Echelon NEURON-based LonWorks™ hardware, although any intelligent system capable of communicating with other modules over a communication network is contemplated. The control module 94 of actuator modules 16, 18 includes an Echelon NEURON processor 95 coupled to a network interface module 96 and a flash memory 97. Network interface module 96 is coupled to the peer-to-peer communication network 30.

Echelon NEURON processors 95 in actuator modules 16, 18 execute software stored in flash memory 97 and internal memory (not shown) to perform closed loop control of valves 88, 90 based on control signals received from flow controller modules 12, 14 over communication network 30 and valve position feedback signals received from position feedback encoders 98 that are coupled to valves 88, 90. Each feedback encoder 98 is coupled to Echelon NEURON processors 95 through an Input/Output conditioning circuit 99 that filters and digitizes the position signal. Feedback encoders 98 are wiper pickups coupled to resistive encoder elements on the shaft of butterfly valves 88, 90 calibrated to 0.05 degree resolution, although any suitable valve position sensor design is contemplated.

Stepping motor 92 is coupled to Echelon NEURON processor 95 through a motor drive circuit 100 and motor logic circuit 101 that conform the command from Echelon NEURON processor 95 to the electrical interface of motor 92. Each of the control modules 94 receives a valve position setpoint from one of flow controller modules 12, 14 over communication network 30, and each Echelon NEURON processor 95 performs closed loop control of one of valves 88, 90 by commanding stepping motor 92 based on a valve position feedback signal from encoder 98.

Valve actuator modules 16, 18 also include power supply circuitry 102 that filters external power 45 for use by other components within the modules. Modules 16, 18 further include a data acquisition circuit 103 coupled to Echelon NEURON processor 95 that allows for monitoring of internal signal parameters for safety and proper operation, such as motor drive current, as well as providing for communication of internal module signal values to communication network 30.

The burner control system 10 provides a system for precise and efficient control of the air-fuel ratio to a burner 24. The modular architecture allows part of the system to be incorporated into an existing design for reduced application requirements. For example, a flow controller and valve actuator pair could be retrofitted into an existing system to replace the fluid control element for a fluid supply pipe. The system could also be expanded to accommodate enhanced control, such as by using continuous emissions feedback in determining air and fuel setpoints. The intelligent, modular architecture allows for adaptation of the control system to accommodate changes in burner system, such as or modification to account for a new or changed burner characterization, by updating the software used within the modules. Similarly, the burner control system can be optimized for a particular characteristic, such as emissions reduction, again by software within one or more of the modules. By including a characterization of burner emissions performance burner control system 10 provides the ability to predict emissions from an operational burner. Furthermore, the ability of the system to provide external and internal operating parameters to the communications network enhances the ability to monitor and optimize the system.

The network-based, modular architecture of the present invention enhances the ability to expand the burner control system 10, such as by adding an additional processor to network 30 to increase the computational capacity. Similarly, additional intelligent sensors can readily be attached to network 30, such as an optical flame sensor, to provide further control, diagnostic or safety features. Moreover, the network-based architecture improves the system diagnostic capability, such as the ability to isolate and correct a defective valve actuator 16, 18 or valve 88, 90 based on the ability to monitor signals and control modules over network 30. The use of modular components based on a standard communication network and protocol such as Echelon LonWorks™ further provides for increased expandability and reduced cost.

Although the invention has been described in detail with reference to certain preferred embodiments, variations and modifications exist within the scope and spirit of the present invention as described and defined in the following claims.

What is claimed is:

1. An intelligent burner control apparatus for controlling the flow rate of a fluid flowing from a fluid supply to a burner, the apparatus comprising a flow controller including a sensor configured to measure the flow rate of the fluid flowing from the fluid supply to the burner, the flow controller being configured to determine a flow control signal based on a measured fluid flow rate, a flow regulator configured to receive the flow control signal, the flow regulator including a valve movable to control the flow rate of the fluid in response to the flow control signal, and a flow monitor configured to monitor a change in the position of the valve with respect to the measured fluid flow rate.

2. The apparatus of claim 1, further comprising a communication network.

3. The apparatus of claim 2, further comprising a plurality of network control modules communicating with each other over the communication network.

4. The apparatus of claim 3, wherein the flow controller further includes one of the network control modules, and the one of the network control modules is coupled to the communication network to send and communicate onto the communication network the flow control signal.

5. The apparatus of claim 3, wherein the flow regulator further includes one of the network control modules, and the one of the network control modules is coupled to the communication network to receive the flow control signal.

6. The apparatus of claim 1, wherein the flow regulator further includes an actuator configured to move the valve in response to the flow control signal, the position of the actuator corresponding to the position of the valve.

7. An intelligent burner control apparatus for controlling the flow rate of a fluid flowing from a fluid supply to a burner, the apparatus comprising a flow controller including a sensor configured to measure the flow rate of the fluid flowing from the fluid supply to the burner, the flow controller being configured to determine a flow control signal based on a measured fluid flow rate, a flow regulator configured to receive the flow control signal, the flow regulator including a valve movable to control the flow rate of the fluid in response to the flow control signal, and a flow monitor configured to monitor a position change of the valve with respect to the measured fluid flow rate and to produce an alarm signal when the position change of the valve with respect to the measured fluid flow rate is outside of a predetermined threshold.

8. The apparatus of claim 7, further comprising a communication network.

9. The apparatus of claim 8, further comprising a plurality of network control modules communicating with each other over the communication network.

10. The apparatus of claim 9, wherein the flow controller further includes one of the network control modules, and the one of the network control modules is coupled to the communication network to send and communicate onto the communication network the flow control signal.

11. The apparatus of claim 9, wherein the flow regulator further includes one of the network control modules, and the one of the network control modules is coupled to the communication network to receive the flow control signal.

12. The apparatus of claim 7, wherein the flow regulator further includes an actuator configured to move the valve in response to the flow control signal, the position of the actuator corresponding to the position of the valve.

13. A burner control apparatus comprising a fuel flow controller including a fuel flow sensor configured to measure a fuel flow rate of fuel flowing from a fuel supply to a burner, the fuel flow controller being configured to determine a fuel flow control signal based on a measured fuel flow rate, an air flow controller including an air flow sensor configured to measure an air flow rate of air flowing from an air supply to the burner, the air flow controller being configured to determine an air flow control signal based on a measured air flow rate, a fuel flow regulator configured to receive the fuel flow control signal, the fuel flow regulator including a fuel valve positioned to intercept the fuel flowing from the fuel supply to the burner, the fuel valve being movable to control the fuel flow rate in response to the fuel flow control signal, an air flow regulator configured to receive the air flow control signal, the air flow regulator including an air valve positioned to intercept the air flowing from the air supply to the burner, the air valve being movable to control the air flow rate in response to the air flow control signal, and a flow monitor including a fuel flow rate monitor, a fuel valve monitor, an air flow rate monitor, and an air valve position monitor, the fuel flow rate monitor being configured to monitor the measured fuel flow rate, the fuel valve position monitor being configured to monitor a position change of the fuel valve relative to the measured fuel flow rate, the air flow rate monitor being configured to monitor the measured air flow rate, and the air valve position monitor being configured to monitor a position change of the air valve relative to the measured air flow rate.

14. The burner control apparatus of claim 13, further comprising a burner brain module configured to cooperate with the air and fuel flow controllers and the air and fuel flow regulators to control the flow of air and gas to the burner.

15. The burner control apparatus of claim 14, wherein the flow monitor includes a micro-processor embedded in the burner brain module.

16. The burner control apparatus of claim 13, wherein the air valve position monitor continuously monitors and records changes in the position of the air valve with respect to the measured air flow rate.

17. The burner control apparatus of claim 16, wherein the fuel valve position monitor continuously monitors and records changes in the position of the fuel valve with respect to the measured fuel flow rate.

18. The burner control apparatus of claim 13, further comprising a communication network and network control modules coupled to the communication network, the flow monitor including a micro-processor embedded in one of the network control modules.

* * * * *